US005212350A

United States Patent [19]

Gebs

[11] Patent Number: 5,212,350

[45] Date of Patent: May 18, 1993

[54] FLEXIBLE COMPOSITE METAL SHIELD CABLE

[75] Inventor: Bernhart A. Gebs, Richmond, Ind.

[73] Assignee: Cooper Industries, Inc., Houston, Tex.

[21] Appl. No.: 760,264

[22] Filed: Sep. 16, 1991

[51] Int. Cl.[5] ..... H01B 11/18

[52] U.S. Cl. ..... 174/102 R; 156/50; 156/51; 174/36; 174/106 R; 174/108

[58] Field of Search ..... 174/102 R, 106 R, 36, 174/108; 156/47, 50, 51

[56] References Cited

U.S. PATENT DOCUMENTS

| | | | |
|---|---|---|---|
| 3,794,750 | 2/1974 | Garshick | 174/36 |
| 3,927,247 | 12/1975 | Timmons | 174/36 |
| 4,091,291 | 5/1978 | Foster et al. | 174/106 R X |
| 4,157,518 | 6/1979 | McCarthy | 174/117 FF X |
| 4,486,252 | 12/1984 | Lloyd | 156/51 |
| 4,694,122 | 9/1987 | Visser | 174/106 R |
| 4,910,391 | 3/1990 | Rowe | 174/36 X |
| 4,970,352 | 11/1990 | Satoh | 174/106 R |
| 5,068,497 | 11/1991 | Krieger | 174/106 R |

FOREIGN PATENT DOCUMENTS

| | | | |
|---|---|---|---|
| 710254 | 7/1941 | Fed. Rep. of Germany | 174/106 R |
| 2385194 | 11/1978 | France | 174/106 R |

*Primary Examiner*—Morris H. Nimmo
*Attorney, Agent, or Firm*—Eddie Scott; Nelson Blish

[57] ABSTRACT

A flexible shielded cable (20). The cable includes an elongate flexible metal conductor (24) and a layer of a flexible dielectric material (26) disposed about the conductor. The cable has a flexible metallic shield (28) positioned about the dielectric material with the shield including a copper foil (30) having overlapping edges (36) and a copper, spirally served shield (32) about the foil. A layer of metal bonds together the overlapping edges, bonds the spirally served shield and the foil and closes the openings of the spirally served shield. A method of forming a metallic shield is also disclosed.

20 Claims, 3 Drawing Sheets

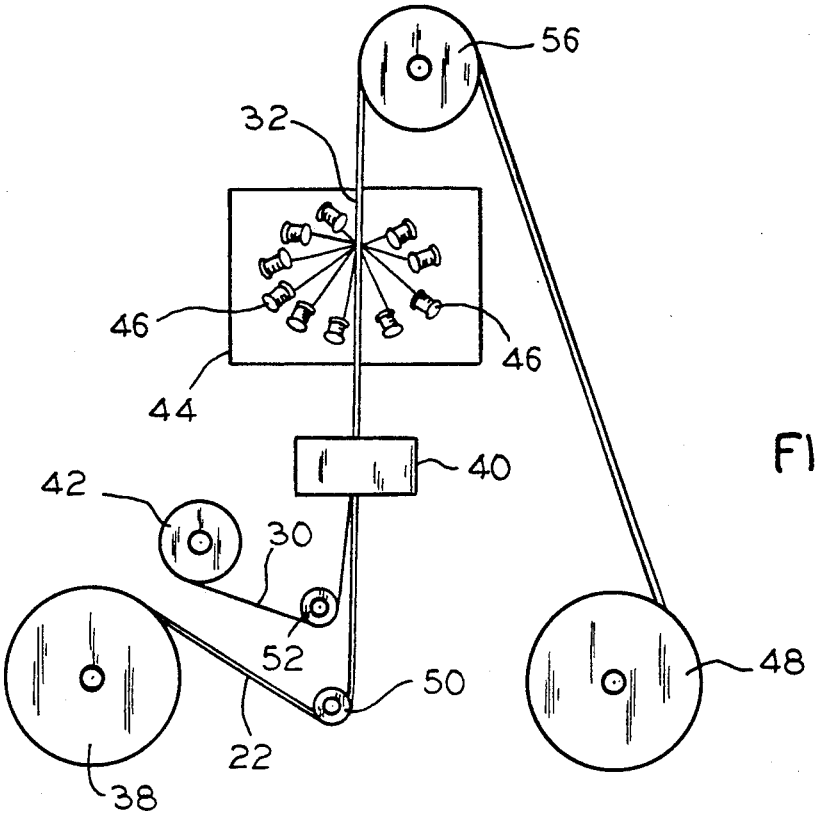
FIG.4
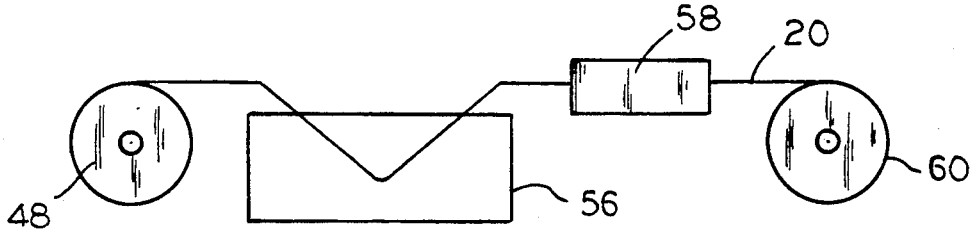
FIG.5
FIG.6
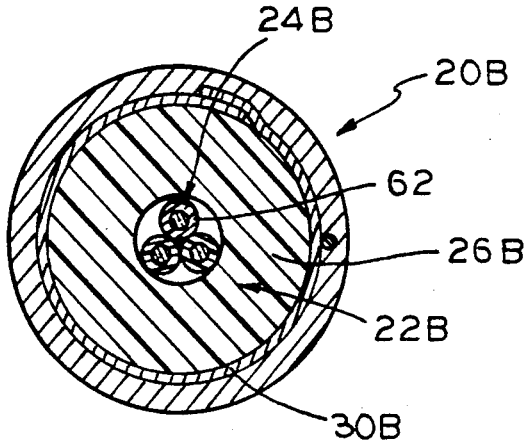

FLEXIBLE COMPOSITE METAL SHIELD CABLE

This patent, is an improvement over U.S. Pat. No. 4,694,122. The present invention relates to electrical cables and, more specifically, to a flexible coaxial cable having excellent shield effectiveness over a broad frequency range.

BACKGROUND OF THE INVENTION

Shielded cables are typically classified as flexible, semirigid or rigid, with cables having greater rigidity typically having more predictable electrical properties. A flexible shielded cable usually has a shield formed of braided copper. While such a shield may perform satisfactorily at low frequencies, the openings in the braid permit high frequency energy transfer thus limiting the use of such cables.

A common type of semirigid coaxial cable includes a copper tubing into which the core assembly (made up of the central conductor and its dielectric jacket) is inserted. This type of coaxial cable is relatively expensive because it is not manufactured in a continuous process. A length of the core assembly is inserted into a length of tubing, and the tubing is shrunk by swaging resulting in a tight fit. While the formed copper tubing does provide a smooth, continuous inner shield surface for effective shielding over a wide frequency range, it has severe mechanical shortcomings. This type of coaxial cable is relatively heavy, not very flexible, and special tools are required for bending without kinking or breaking the shield. The use of the copper tubing, which has minimum elasticity, also limits the maximum operating temperature to the cable.

A recently developed coaxial cable includes a layer of conductive or semi-conductive matter surrounding the dielectric. A shield, which may be a braid, is embedded in the layer which is softened by heating. For further information regarding the structure and operation of this cable, reference may be made to U.S. Pat. No. 4,486,252.

Another type of coaxial cable, described in U.S. Pat. No. 4,694,122, includes a layer of foil surrounding the dielectric, braided shield over the foil, and molten material bonding the braid and foil. A problem with this structure is that the braiding operation is relatively slow.

SUMMARY OF THE INVENTION

The present invention is an improved flexible shielded cable. The cable of the present invention offers effective shielding over a wide frequency range, and can undergo relatively sharp bending without the use of any special tools and without damage to the shield. The cable also is usable at higher operating temperatures than copper tubing coaxial cables. Additionally, the cable can be made in very long continuous lengths as opposed to semirigid cable with a solid copper tubing shield, which is limited in length because the dielectric core must be shoved into the copper tubing prior to swaging. The shielded cable of the present invention has long service life, is reliable in use and is easy and economical to manufacture. Other aspects and features will be in part apparent and in part pointed out in the following specification and drawings.

The flexible shielded cable of the present invention includes a flexible metal conductor, a layer of dielectric positioned about the conductor, and a flexible metallic shield disposed about the dielectric. The shield has a copper foil with overlapping edges and a copper, spirally served shield about the foil. The shield also has a layer of metal bonding together the overlapping edges, bonding the spirally served shield and the foil, and enclosing the openings of the braid.

As a method of forming a metallic shield, the present invention includes several steps: A copper foil is wrapped about the dielectric so that the foil has overlapping edges; a copper spirally served shield is wound over the foil; and the cable is passed through a bath of molten metal which bonds to the spiral shield and the foil so that the overlapping edges of the foil are closed and the openings of the spiral shield are filled.

BRIEF DESCRIPTION OF THE DRAWINGS

FIG. 4 is a diagram illustrating application of the foil and application of a spirally served shield around the core assembly of the cable of FIG. 1;

FIG. 5 is a diagram, partly block in nature, depicting application of solder or tin which bonds the spirally served shield to the foil and closes the openings of the spiral shield;

FIG. 6, similar to FIG. 1, illustrates another alternative embodiment of a cable embodying various features of the present invention wherein a plurality of insulated conductors are present in the core assembly;

DESCRIPTION OF THE PREFERRED EMBODIMENTS

Figure 1:
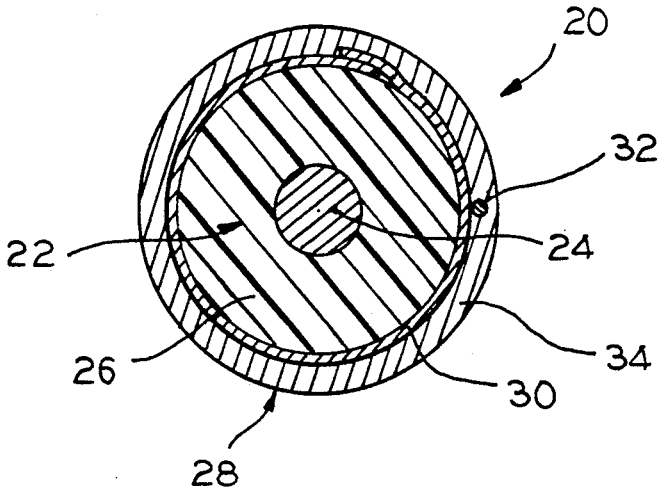
FIG. 1 is a cross-sectional view of a shielded cable embodying various features of the present invention.
Figure 2:
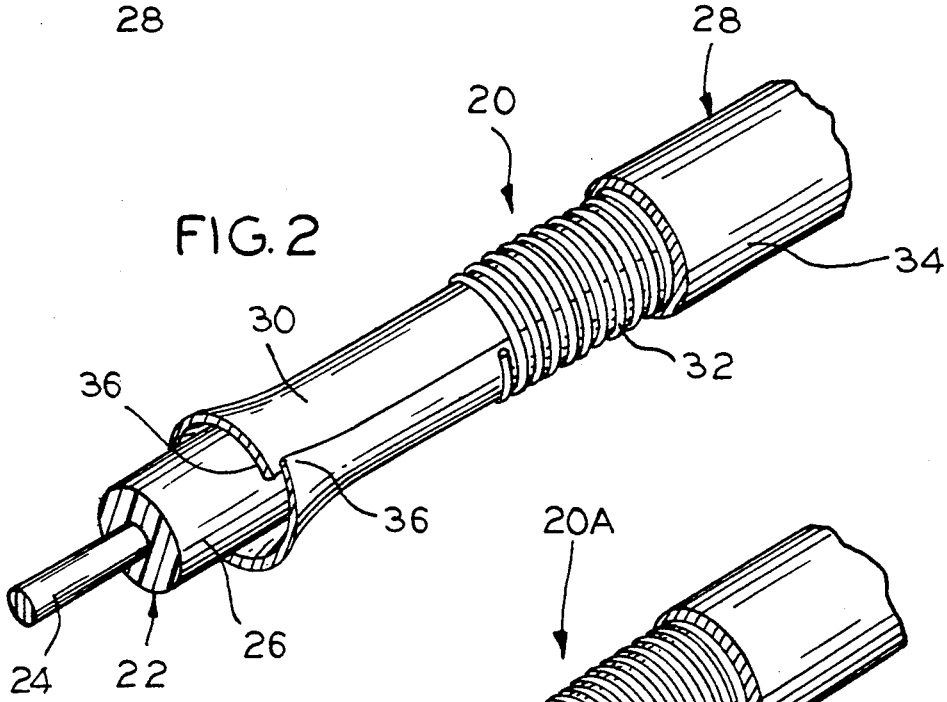
FIG. 2 is a perspective view of the cable of FIG. 1, with various components removed to illustrate underlying components, having a shield made up in part by a longitudinally wrapped foil.

Referring now to the drawings, a shielded cable of the present invention is generally indicated in FIGS. 1 and 2 by reference character 20. The cable 20 has a core assembly 22 made up of an elongate, flexible central metallic conductor 24 which is preferably copper and could be either solid or made up of a number of strands. While only a single conductor 24 is illustrated in the core assembly in FIGS. 1-3, it will be appreciated that a number of conductors, insulated from each other, could be included. Encompassing the conductor 24 is a flexible layer 26 of dielectric material in intimate contact with the conductor. Disposed about the dielectric layer 26 is a flexible metallic shield 28 made up of a copper foil 30, a copper wire spirally served shield 32 about the foil 30 and a layer 34 of metal such as solder or tin which bonds the spiral shield 32 to the foil 30 and closes the openings or interstices of the spiral shield.

As best shown in FIG. 2, the foil 30 has overlapping, longitudinally extending edges 36. The layer 34 of metal also bonds the overlapping edges 36 together to provide the shield 28 with an inner surface which is substantially smooth and has no openings through which energy could be radiated. It will be appreciated that this approximates the smooth inner surface of the copper tube of a semirigid coaxial cable. Thus, the shield 28 greatly reduces undesirable energy or signal transfer through the shield due to electrical, magnetic or electromagnetic fields. The cable 20 can be used over a broad frequency range, from dc to 20 gigahertz. Grounding a shield 28 results in predictable cable impedance and signal attenuation.

More specifically, the copper foil, which preferably has a thickness in the range of 0.003 inch to 0.0003 inch, functions to limit high frequency signal penetration. It will be appreciated that the only discontinuity in the foil, where the edges 36 overlap, extends in the axial direction of the cable. Current tends to flow in the direction of the discontinuity. Because the discontinuity does not take an arcuate path, there is no substantial increase in inductive signal couplings through the shield 28 due to the presence of the discontinuity.

The spirally served shield 32 functions to limit penetration of low frequency signals. The use of the spirally served shield 32 over the foil 30 results in low radio frequency leakage and low susceptibility to electrical noise. The spirally served shield 32 being bonded to the foil 30 by the metal layer 34 also offers several mechanical advantages. The presence of the spirally served shield prevents tearing of the foil when the cable 20 is bent. Furthermore, the spirally served shield offers a degree of elasticity, permitting the cable to have a higher operating temperature than an otherwise comparable semirigid cable incorporating a shield of copper tubing. The prior art cable is limited to an operating temperature of about 150° C. because the tubing has minimal elasticity so that an substantial expansion of the dielectric must be in the axial direction. Operating of this prior art cable at higher temperatures can result in damage to the tubing or to other components of the cable. The cable 20 of the present invention has a maximum operating temperature of about 200° C. because of the spirally served shield provides a greater degree of elasticity, allowing some radial expansion of the dielectric layer 26.

The dielectric layer 26 is preferably formed of a flexible thermoplastic polymer such as Teflon, a registered trademark of DuPont for synthetic resins containing fluorine, polyethylene, polypropylene and cellular forms thereof. The layer of metal 34 if applied by passing the incipient cable through a molten bath of tin or solder. This causes the molten material, which is drawn in by wicking action-capillary attraction, to fill the spirally served shield openings and to close any hairline opening between the overlapping edges 36. During the application of the molten tin or solder component, the copper foil 30 functions as a heat barrier to insulate the dielectric material from the high temperature of the molten metal. But for the foil, the molten metal would directly contact the core insulation material. The use of the foil 30 allows polymers having less heat resistance than Teflon to be used for dielectric layer 26 because the foil conducts heat away from layer 26.

The cable 20 is flexible and can be bent without the use of special tools such as are required to prevent kinking or breaking of the cable having a copper tubing shield. Due to its flexible components, the bend radius of the cable 20 is approximately equal to the outside diameter of the cable which is preferably in the range of 0.047 inch to 0.50 inch.

Referring to FIG. 4, there is shown the application of the foil 30 and the spirally served shield 32 about the core assembly 22. After the core assembly is taken off a pay-out reel 38, it passes through a first station 40 which applies the foil wrapping 30, taken from a foil pay-out reel 42, so that the edges 36 of the foil overlap. Next the partially completed cable passes through a second station 44 which wraps strands of copper wire, taken from a plurality of wire spools 46, to form the spirally served shield over the copper foil 30. The cable is taken up on a reel 48. Idler wheels 50, 52, and 56 are provided for guiding the core assembly 22, the foil 30 and the cable with the foil wrapping and the spirally served shield, respectively.

As shown in FIG. 5, the reel 48 can be used as the pay-out reel for the tin or solder application. The foil wrapped, shielded cable passes through a bath 56 of molten solder or tin. Because the cable is submerged in the molten metal, the interstices of the spiral shield 32 are filled, the shield is bonded to the copper foil 30, and the hairline opening due to the presence of the overlapping edges 36 of the foil is closed. Finally, the shielded cable 20 passes through a cooling station 58 and then is taken up on a reel 60. It is not economically feasible to combine the foil wrapping station, shielding station, and tin or solder application in a single, continuous process because the several stations operate at greatly differing speeds. The soldering application station is significantly faster than a serving station. The cable 20 is made in very long continuous lengths compared to semirigid cable with the solid copper tubing shield, which is limited because a length of dielectric core must be pushed into the copper tubing prior to swaging.

Figure 3:
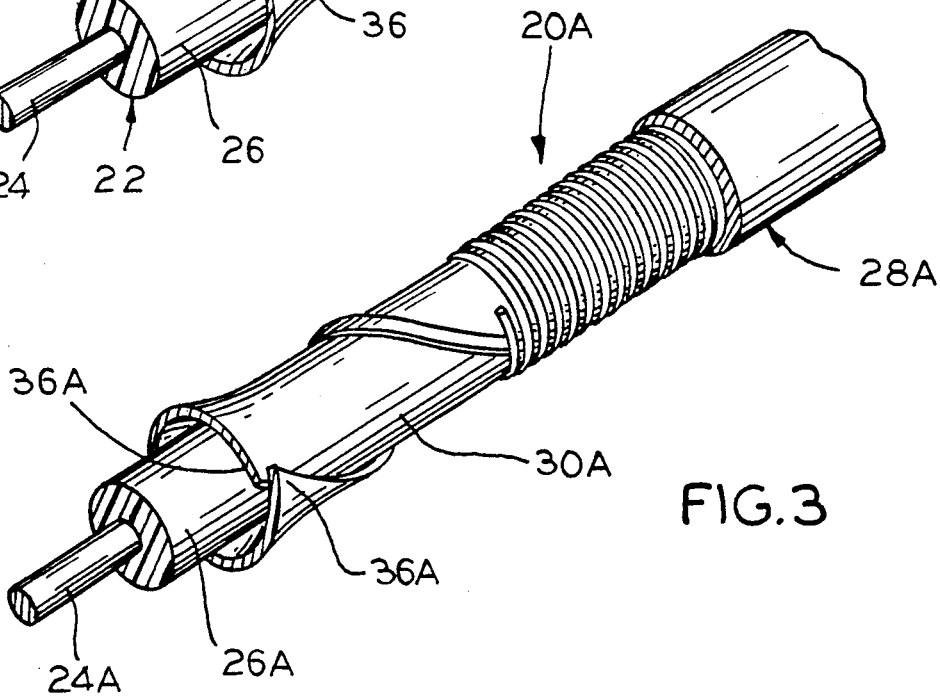
FIG. 3, similar to FIG. 2, illustrates an alternative embodiment of the shielded cable of the present invention wherein the foil is helically wound.

Referring to FIG. 3, an alternate embodiment of the cable of the present invention is shown by reference character 20A. Components of cable 20A corresponding to components of cable 20 are indicated by the reference numeral applied to the component of the cable 20 with the addition of the suffix "A." The primary difference between cable 20A and cable 20 is that the foil 30A is applied helically so that the overlapping edges 36A of the wrapped foil form an arcuate path. The presence of this arcuate path, along which current tends to flow, may result in undesirable inductive signal coupling through the shield 28A reducing shield performance at higher frequencies. Spirally served shield 32 may be wound counter-helically to foil 30A.

Figure 7:
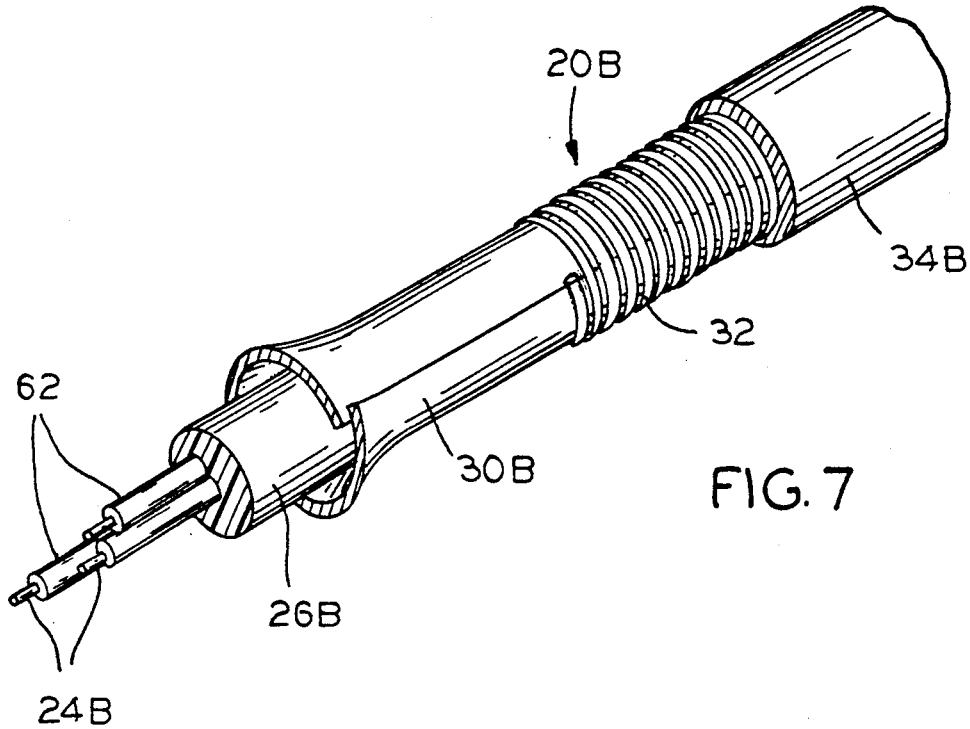
FIG. 7 is a perspective view of the cable shown in FIG. 6 with various components removed to illustrate underlying components, having a shield made up in part by a longitudinally wrapped foil.

Another alternative embodiment of the cable of the present invention is shown by reference character 20B in FIG. 6 and FIG. 7. Components of the cable 20B corresponding to components of cable 20 are indicated by the numeral applied to the component of the cable 20 with the application of the suffix "B." In the cable 20B, the core assembly 22B is made up of several conductors 24B, which could be either solid or formed of a number of strands. Each of the conductors has a jacket 62 of flexible insulation. Encompassing the conductors 24B is a flexible layer 26B of dielectric material tightly holding the conductors which may run in parallel relationship or may be cabled, twisted about the axis of the cable. The remainder of the cable 20B is substantially identical in construction to cable 20.

Figure 8:
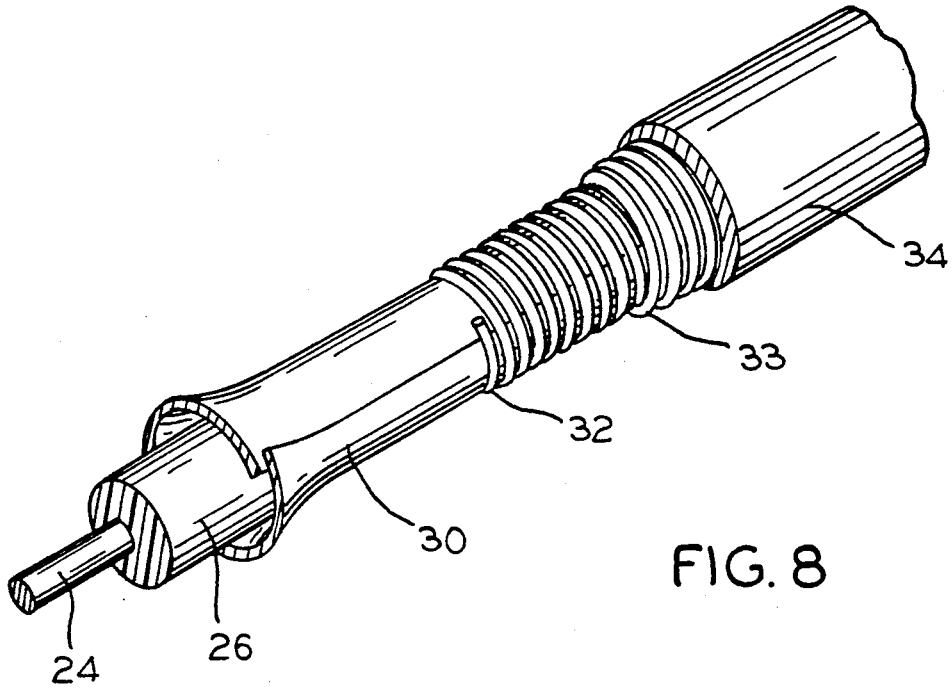
FIG. 8 is a perspective view of the cable shown in FIG. 2 with a second spirally served shield.

FIG. 8 shows a alternate embodiment where a second spirally served metal shield 33 similar to metal shield 32 shown in FIG. 2 is wrapped in a counter helical fashion about metal shield 32 prior to the addition molten tin or solder.

As a method of forming a metallic shield 28 about a flexible metal conductor 24 encompassed by a layer of dielectric material 26 to form a flexible coaxial cable 20, the present invention includes several steps:

(A) A copper foil 30 is wrapped about the layer 26 so that the foil 30 has overlapping edges 36.

(B) A copper spirally served shield 32 is applied over the foil. This may be done using one or more spools.

(C) The cable is passed through a bath of molten metal to form a layer 34 which bonds to the spiral shield and the foil so that the overlapping edges of the foil are closed and the interstices of the spirally served shield are filled.

The method can also include the further step of cooling the cable after its exit from the bath. An additional step may be the addition of a second spirally served shield before the cable is passed through the molten metal bath.

In view of the above, it will be seen that the several objectives of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

I claim:

1. A flexible shielded cable comprising:

an elongate, flexible metal conductor;

a layer of a flexible dielectric material disposed about said conductor; and a flexible metallic shield disposed about said layer, said shield including a copper foil having overlapping edges, a first copper wire spirally served shield about the foil, and a layer of metal which closes any opening between said overlapping edges, bond said spirally served shield and said foil and closes the interstices of said spirally served shield whereby said shield is flexible and has no openings therein.

2. A cable as set forth in claim 1 wherein said overlapping edges of said foil extend longitudinally.

3. A cable as set forth in claim 1 wherein said overlapping edges are helical.

4. A cable as set forth in claim 3 wherein said spirally served shield is wound counter-helically to said overlapping edges of said foil.

5. A cable as set forth in claim 1 wherein said layer of metal is solder.

6. A cable as set forth in claim 1 wherein said layer of metal is tin.

7. A cable as set forth in claim 1 wherein said foil has a thickness in the range of 0.0003 inch to 0.003 inch.

8. A cable as set forth in claim 1 having an outer diameter in the range of 0.047 inch to 0.5 inch.

9. A cable as set forth in claim 1 wherein said dielectric material is a thermoplastic.

10. A cable as set forth in claim 9 wherein said dielectric material is cellular polyethylene.

11. A cable as set forth in claim 9 wherein said dielectric material is cellular polypropylene.

12. A cable as set forth in claim 9 wherein said dielectric material is cellular Teflon.

13. A cable as set forth in claim 9 wherein said dielectric material is polyethylene.

14. A cable as set forth in claim 9 wherein said dielectric material is polypropylene.

15. A cable as set forth in claim 9 wherein said dielectric material is Teflon.

16. A cable as set forth in claim 1 wherein said conductor and said shield are coaxial.

17. A cable as set forth in claim 1 wherein a plurality of flexible conductors, each insulated from the other conductors, are encompassed by said layer of flexible dielectric material.

18. A cable as set forth in claim 1 wherein a second spirally served shield is wrapped in a direction counter helically to said first spirally served shield.

19. A method of forming a metallic shield about a flexible metal conductor encompassed by a layer of dielectric material to form a flexible coaxial cable, said method comprising:

providing a flexible metal conductor encompassed by a layer of dielectric material;

wrapping a copper foil about said layer of dielectric material so that said foil has overlapping edges;

applying a copper wire spirally served shield over said foil; and passing the cable through a bath of a molten metal which bonds to said spirally served shield and said foil so that any opening between said edges of said foil is closed and the interstices of said spirally served shield are closed.

20. A method of forming as set forth in claim 19 further comprising the step of cooling said cable after its exit from said bath.

* * * * *